US010928057B2

(12) United States Patent
Brabec et al.

(10) Patent No.: US 10,928,057 B2
(45) Date of Patent: Feb. 23, 2021

(54) DOMESTIC COOLING DEVICE HAVING A WALL LIGHTING MODULE

(71) Applicant: emz-Hanauer GmbH & Co. KGaA, Nabburg (DE)

(72) Inventors: Martin Brabec, Nabburg (DE); Manfredi Signorino, Wackersdorf (DE); Georg Wilhelm, Guteneck (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 0 days.

(21) Appl. No.: 16/253,398

(22) Filed: Jan. 22, 2019

(65) Prior Publication Data

US 2019/0242570 A1 Aug. 8, 2019

(30) Foreign Application Priority Data

Feb. 5, 2018 (DE) ..... 10 2018 001 168.3

(51) Int. Cl.
*F21V 33/00* (2006.01)
*F21V 19/00* (2006.01)
(Continued)

(52) U.S. Cl.
CPC ..... *F21V 33/0044* (2013.01); *F21V 7/0008* (2013.01); *F21V 7/24* (2018.02);
(Continued)

(58) Field of Classification Search
CPC . F21V 33/0044; B28C 5/4224; B60T 8/17554
See application file for complete search history.

(56) References Cited

U.S. PATENT DOCUMENTS 2,737,573 A * 3/1956 Olthuis ..... D06F 39/005 362/91
3,047,829 A * 7/1962 Mouat ..... F21V 19/00 362/549
(Continued)

FOREIGN PATENT DOCUMENTS

CA 2559185 A1 9/2005
DE 602005005262 T2 4/2009
(Continued)

OTHER PUBLICATIONS

German office action in priority application DE 10 2018 001 168.3 dated Oct. 30, 2018.

*Primary Examiner* — Ismael Negron
*Assistant Examiner* — Christopher E Dunay
(74) *Attorney, Agent, or Firm* — Robert R. Deleault, Esq; Mesmer & Deleault, PLLC

(57) ABSTRACT

A domestic cooling device has a cold chamber delimited by walls, and at least one lighting module fitted into a wall opening of a delimiting wall of the cold chamber. The lighting module includes a light outlet pane, a light source arrangement having at least one light-emitting diode, a reflector body which reflects light in the direction towards the light outlet pane, which light reflection surface is irradiated by each light-emitting diode of the light source arrangement, and a frame part which is produced separately from the reflector body and protrudes from the delimiting wall on the side thereof facing towards the cold chamber, which frame part forms a visible surface which extends all around the light outlet pane and is exposed towards the cold chamber. The frame part is a surface-coated plastics component which is held in place by engaging the underside of the light outlet pane.

16 Claims, 3 Drawing Sheets

(51) Int. Cl.

| | |
|---|---|
| ***F21V 7/00*** | (2006.01) |
| ***F21V 7/24*** | (2018.01) |
| ***F21V 15/01*** | (2006.01) |
| ***F25D 27/00*** | (2006.01) |
| *F21W 131/305* | (2006.01) |
| *F21Y 115/10* | (2016.01) |

(52) U.S. Cl.

CPC ..... *F21V 15/01* (2013.01); *F21V 19/003* (2013.01); *F25D 27/00* (2013.01); *F21W 2131/305* (2013.01); *F21Y 2115/10* (2016.08)

(56) References Cited

U.S. PATENT DOCUMENTS

| | | | | |
|---|---|---|---|---|
| 5,068,771 | A * | 11/1991 | Savage, Jr. | F21S 8/00 362/255 |
| 6,364,512 | B1 * | 4/2002 | Logel | F21V 17/164 362/490 |
| 6,578,978 | B1 * | 6/2003 | Upton | A47F 3/001 362/125 |
| D493,906 | S * | 8/2004 | Park | D26/74 |
| 7,147,341 | B2 | 12/2006 | Nowak et al. | |
| 2003/0161137 | A1 * | 8/2003 | Schach | B60Q 3/64 362/23.17 |
| 2005/0122709 | A1 * | 6/2005 | Ha | F24C 15/008 362/92 |
| 2005/0126609 | A1 * | 6/2005 | Son | A47L 15/4246 134/56 D |
| 2006/0138916 | A1 * | 6/2006 | Kordon | F21V 33/0044 312/223.5 |
| 2008/0007945 | A1 | 1/2008 | Kelly et al. | |
| 2008/0204888 | A1 | 8/2008 | Kan et al. | |
| 2010/0157607 | A1 | 6/2010 | Venhaus | |
| 2011/0038171 | A1 | 2/2011 | Uchida | |
| 2011/0277493 | A1 * | 11/2011 | Becke | F25D 27/00 62/264 |
| 2012/0268962 | A1 | 10/2012 | Uchida | |
| 2012/0269997 | A1 * | 10/2012 | Poppi | H01J 33/04 428/34.1 |

FOREIGN PATENT DOCUMENTS

| | | | |
|---|---|---|---|
| DE | 102013004042 | A1 | 9/2014 |
| JP | 2005302988 | A | 10/2005 |
| JP | 2007132562 | A | 5/2007 |
| JP | 2008051366 | A | 3/2008 |
| JP | 2011163668 | A | 8/2011 |

* cited by examiner

DOMESTIC COOLING DEVICE HAVING A WALL LIGHTING MODULE

BACKGROUND OF THE INVENTION

1. Field of the Invention

The present invention relates generally to a domestic cooling device having a wall lighting module which is fitted into a wall surface of a cold chamber of the cooling device.

2. Description of the Prior Art

Conventional domestic refrigerators frequently have one or more lighting devices by means of which the interior of the refrigerator, which serves to keep foods cold, is illuminated when the door is open so that a user is better able to see the foods stored therein. In some known solutions, a lighting module is fitted into a (e.g. side or rear) delimiting wall of the cold chamber, so that the user perceives the lighting module as an integral part of the wall surface.

For decorative purposes, consideration may be given, in the case of such a wall lighting module, to mounting a light outlet pane, through which the light of the lighting module enters the cold chamber, in a peripheral visible frame which stands out optically from the surrounding parts of the delimiting wall of the cold chamber and from the other visible parts of the lighting module, especially from the visible part of a reflective surface arranged behind the light outlet pane. Aesthetically appealing decorative surfaces can be achieved by surface coating a plastics component, for example by lacquering or chromium plating.

However, the surface coating may stand in the way of the desire to weld, in particular ultrasonically weld, the light outlet pane to the visible frame. One way out could be to mask, while the surface coating is being applied, those regions of the plastics component in which a welded connection is subsequently to be produced. However, masking a portion of the plastics component during the coating process is associated with an additional outlay, which can lead not only to lengthening of the manufacturing times but also to undesirable additional waste owing to the masking material used for masking.

SUMMARY OF THE INVENTION

It is an object of the present invention to provide a construction for a wall lighting module for a domestic cooling device which makes it possible, with an acceptable outlay in terms of manufacture, to produce the lighting module with a surface-coated decorative frame.

In order to achieve that object there is provided according to the invention a domestic cooling device having a cold chamber delimited by walls, and at least one lighting module fitted into a wall opening of a delimiting wall of the cold chamber, wherein the lighting module comprises: a light outlet pane through which light passes into the cold chamber; a light source arrangement having at least one light-emitting diode; a reflector body which forms a light reflection surface for reflecting light in the direction towards the light outlet pane, which light reflection surface is arranged behind the light outlet pane when viewed perpendicularly to the pane plane of the light outlet pane and is irradiated by each light-emitting diode of the light source arrangement, wherein the light outlet pane is fixed to the reflector body, in particular by a welded, for example ultrasonically welded, connection; and a frame part which is produced separately from the reflector body and protrudes from the delimiting wall on the side thereof facing towards the cold chamber, which frame part forms a visible surface which extends all round the light outlet pane and is exposed towards the cold chamber, wherein the frame part is a surface-coated, in particular lacquered or chromium-plated, plastics component which is held in place by engaging the underside of the light outlet pane.

The domestic cooling device may be in cabinet or chest form, for example. Within the scope of the present disclosure, the expression cooling device not only includes devices in which foods can be stored at a temperature around the freezing point or above. Instead, the expression cooling device is to be interpreted broadly and is also to include those types of device which serve to freeze foods, that is to say to store them in the frozen state.

As a result of the measure that the frame part engages the underside of the light outlet pane, the frame part can be held in place securely and stably at least in the fitted situation of the wall lighting module, without additional fixing members (e.g. screws or the like) and also without the need for a material-based connection (e.g. by adhesive bonding or welding) of the frame part to the reflector body and the light outlet pane. In particular, the reflector body and the light outlet pane can be in such a form that the frame part is held stably between the reflector body and the light outlet pane by interlocking engagement even in the unmounted state of the wall lighting module. Because the frame part engages the underside of the light outlet pane, it cannot fall forwards out of the lighting module, that is to say in the direction towards the front side of the light outlet pane facing towards the cold chamber.

In some embodiments, the surface coating extends on all sides over substantially the entire frame part, so that no particular measures have to be taken in the coating operation to purposively keep specific surface regions of the frame part free of the coating material.

In some embodiments, the reflector body forms a support shoulder which extends within the contour of the light outlet pane at a distance from the pane edge and on which the light outlet pane rests, wherein the frame part engages the underside of the light outlet pane preferably up to the support shoulder.

In some embodiments, the reflector body is a white plastics body. Accordingly, the light reflection surface in these embodiments is also white, it being possible, depending on the application, for it to be polished to a shine or to be provided at least in part-regions with a defined surface roughness in order to achieve a diffuse scattering effect of the light reflection surface in those regions. The reflector body can be produced as a one-piece component in an injection moulding process.

The invention will be explained further below with reference to the accompanying drawings.

BRIEF DESCRIPTION OF THE DRAWINGS

FIG. 3 is a sectional view along line III-III of FIG. 2.

DETAILED DESCRIPTION OF THE INVENTION

Figure 1:
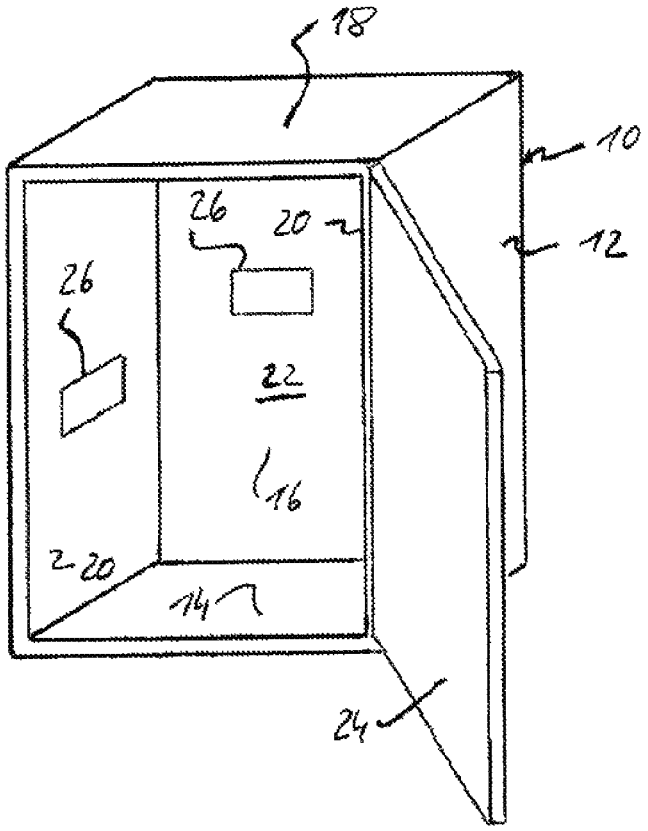
FIG. 1 is a highly schematic representation of a domestic refrigerator with fitted wall lighting modules

Reference will first be made to FIG. 1. The domestic refrigerator shown therein is generally designated 10. It comprises a body 12 having a bottom wall 14, a rear wall 16, a top wall 18 and two mutually opposite side walls 20, which together delimit an interior (cold chamber) 22 of the refrigerator 10. The foods to be stored are kept in the interior 22. To that end, the interior 22 is equipped, in a manner which is not shown in greater detail but is generally known, with one or more shelves or/and one or more drawers on/into which the foods can be placed/introduced. In the example shown in FIG. 1, a door 24 is articulated with the body 12, by means of which door access to the interior 22 can be closed.

When the door 24 is open (as is shown in FIG. 1), it is desirable to light the interior 22 artificially in order to give the user a better view of the foods located therein. To that end there is fitted into at least one of the walls 14, 16, 18, 20 at least one wall lighting module 26, which is so controlled, for example, that it is switched on or off in dependence on the opening and closing of the door 24. In the example shown, a wall lighting module 26 is fitted into the rear wall 16, a further wall lighting module 26 is fitted into the side wall 20 shown on the left in FIG. 1. It will be appreciated that the distribution pattern of the wall lighting modules 26 shown in FIG. 1 is given purely by way of example and can be changed as desired as regards both the number and the position of the wall lighting modules 26. It will additionally be appreciated that the wall lighting modules 26 do not have to be the only lighting means with which the refrigerator 10 is equipped. In addition to the wall lighting modules 26, lighting means of other forms can be provided. Such lighting means of other forms are not subject matter of the present disclosure and do not require further explanation.

Figure 2:
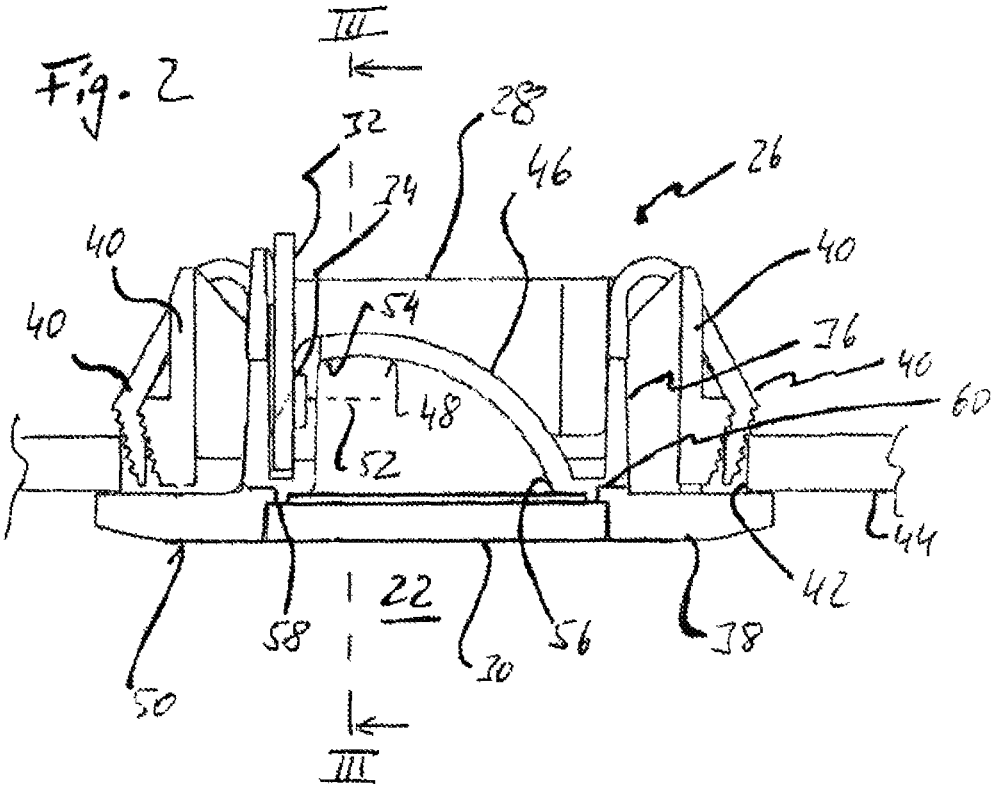
FIG. 2 is a sectional view of a wall lighting module of the refrigerator of FIG. 1 according to an exemplary embodiment
Figure 7:
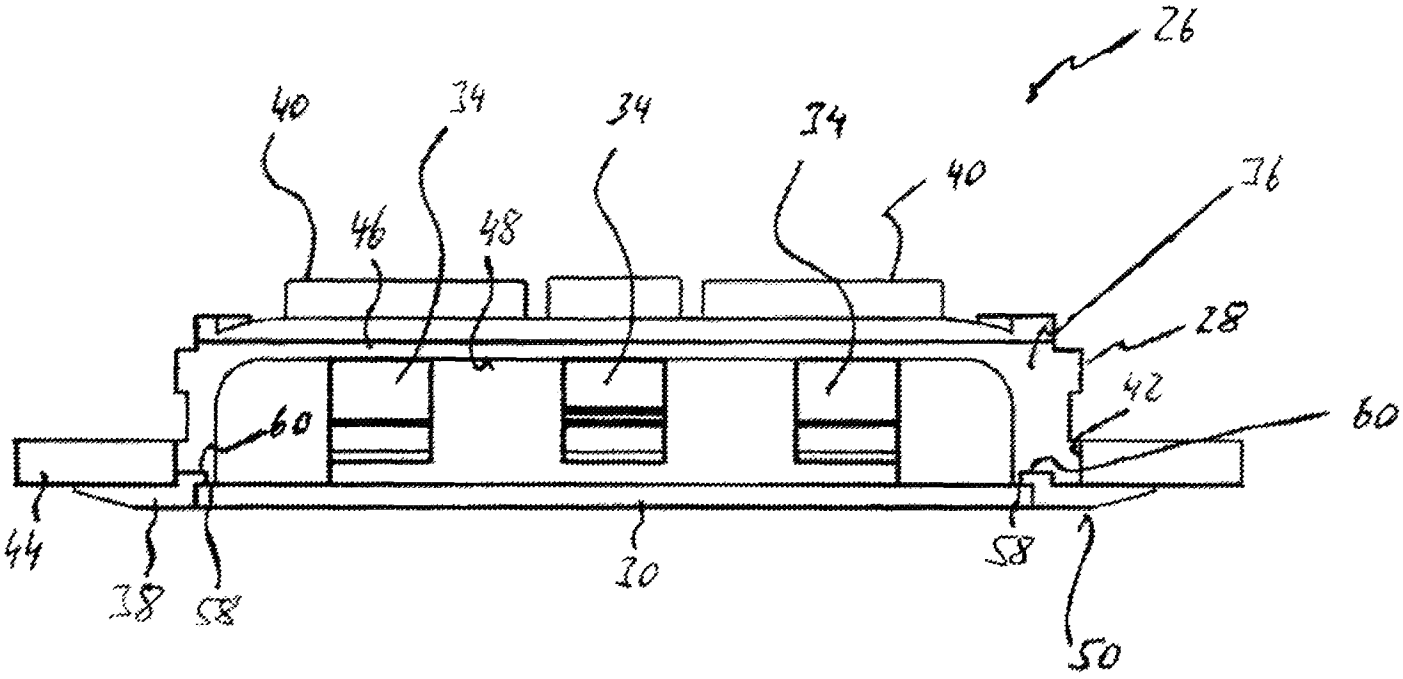

At least one of the wall lighting modules 26 can have the form shown in FIGS. 2 and 3. It should first be pointed out that there is no correspondence between FIGS. 2 and 3 in terms of the size of the structures shown. Nevertheless, FIG. 3 illustrates those structures which would be visible when viewed along the cutting line III-III of FIG. 2.

In the form shown in FIGS. 2 and 3, the wall lighting module 26 comprises a module housing 28, a light outlet pane 30, and a circuit board 32 with a plurality of light-emitting diodes 34 arranged thereon one behind the other in a row. The module housing 28 is composed of a plurality of housing components and comprises a housing base body 36 as well as a visible frame part 38 separate from the housing base body 36. Holding structures in the form of a plurality of resiliently deflectable clamping tongues 40 are formed on the housing base body 36, by means of which clamping tongues the housing base body 36 can be clamped between mutually opposite edge regions of an opening 42 which is formed in a delimiting wall 44. The delimiting wall 44 is one of the walls of the body 12 that delimit the interior 22 of the refrigerator 10. For example, the delimiting wall 44 is part of the rear wall 16 or part of one of the side walls 20 or part of the top wall 18.

The housing base body 36 further comprises a reflector body 46 which forms a light reflection surface 48. From the point of view of the observer standing directly in front of the light outlet pane 30 and looking at the light outlet pane 30 perpendicularly to the pane plane, the light reflection surface 48 is arranged behind the light outlet pane 30. The housing base body 36 with the clamping tongues 40 and the reflector body 46 can be a component produced in one piece, which can be manufactured, for example, from a white plastics material in an injection moulding process. The light reflection surface 48 can have uniform surface properties over the entire region that is visible when viewed perpendicularly through the light outlet pane 30, or it can have part-regions of different surface roughness in that region. In some embodiments, the light reflection surface 48 is formed directly by the plastics material of the reflector body 46, that is to say it is not produced by applying a separate metallic mirror layer.

The visible frame part 38 extends beyond the peripheral edge of the opening 42 and protrudes from the delimiting wall 44 slightly on the side facing towards the interior 22. On its front side facing towards the interior, the visible frame part 38 forms a visible surface 50 which, from the point of view of the user, is exposed towards the interior 22 and extends all round the light outlet pane 30. In order to be able to configure the visible surface 50 as an aesthetically appealing decorative surface, the visible frame part 38 is formed by a lacquered or chromium-plated or otherwise surface-coated plastics component. An aesthetically sophisticated design of the visible frame part 38 can be created by lacquering or chromium plating.

The light outlet pane 30 is set into the visible frame part 38, and its pane front side facing towards the interior 22 adjoins the visible side 50 of the visible frame part 38 in a substantially step-free manner. The light outlet pane 30 has a smaller extent than the opening 42 and, in a notional projection perpendicularly to the pane plane of the light outlet pane 30, is situated wholly within the contour of the opening 42. It is in the form of, for example, a transparent pane having a degree of transmission of at least 90% in the visible spectrum.

The light-emitting diodes 34 are arranged so that they are concealed, such that an observer, when looking perpendicularly to the pane plane of the light outlet pane 30, does not have a direct view of the light-emitting diodes 34. In the example shown, the light-emitting diodes 34 are arranged with their main beam axis (denoted 52) substantially parallel to the pane plane of the light outlet pane 30. The main beam axis 52 is the axis on which the emission pattern of the light-emitting diode 34 in question has the greatest radiation intensity. Typically, the emission pattern of the light-emitting diodes 34 has in each case a main lobe with an opening angle of, for example, more than 90 degrees or more than 120 degrees or more than 150 degrees, it being possible in some circumstances for one or more side lobes additionally to be present. In other embodiments, the circuit board 32 can be at an angle relative to the pane plane of the light outlet pane 30, namely in such a manner that the main beam axis 52 of the light-emitting diodes 34 slopes away from the light outlet pane 30.

When seen in the sectional plane of FIG. 2, which is a plane lying parallel to the main beam axis 52 of the light-emitting diodes 34, the light reflection surface 48 extends curved in an arcuate manner between a first end region 54 and a second end region 56. The first end region 54 is closer to the circuit board 32 than the second end region 56, which is further away from the circuit board 32 and thus further away from the light-emitting diodes 34. At the same time, the light reflection surface 48 is at a greater distance from the light outlet pane 30 in its first end region 54 than in its second end region 56. The profile of the light reflection surface 48 between the first end region 54 and the second end region 56 can follow, for example, a parabola or a spline or any desired conical curve in general. Moreover, the possibility that the light reflection surface 48 is in part in linear form in its profile from the first end region 54 to the second end region 56 is not ruled out.

The reflector body 46 (or generally: the housing base body 36) forms a support shoulder 58 which runs all round the light reflection surface 48 and forms a bearing surface on which the light outlet pane 30 rests along its entire pane periphery. In the region of the support shoulder 58, the light outlet pane 30 is fixed to the reflector body 46 by a material-based connection, there being suitable in particular welding by an ultrasonic welding process. It will be seen in FIGS. 2 and 3 that the support shoulder 58 extends within the contour of the light outlet pane 30 at a slight distance from the pane edge. Space is thus created outside the support shoulder 58 for a peripheral nose 60, which is formed on the visible frame part 38 and with which the visible frame part 38 engages the underside of the light outlet pane 30 at the rear, that is to say on the side of the pane facing away from the interior. This engagement of the underside of the light outlet pane 30 by the visible frame part 38 secures the visible frame part 38 against falling out in the direction towards the interior 22. By being supported against the light outlet pane 30, against the delimiting wall 44 and optionally also against the housing base body 36, the visible frame part 38 is held securely in the wall lighting module 26 without the need for material-based connecting means or separate connecting members for holding the visible frame part 38 in place. Consequently, the visible frame part 38 is positioned stably by interlocking engagement only. The visible frame part 38 can therefore be lacquered or chromium-plated over its entire surface; it is not necessary to keep any part-regions of the surface of the visible frame part 38 free of the surface coating in order to perform ultrasonic welding, for example, in those part-regions.

The reflector body 46 (or generally: the housing base body 36), on the other hand, is an uncoated plastics injection-moulded part which is readily amenable to treatment by ultrasonic welding.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic cooling device capable of cooling food, the domestic cooling device comprising:

a cold chamber accessible through a door opening delimited by walls, and the cold chamber having at least one shelf capable of holding the cooling food; and at least one lighting module fitted into a wall opening of at least one of the delimiting walls of the cold chamber, wherein the lighting module includes:

a light outlet pane through which light passes into the cold chamber, the light outlet pane having a front side facing towards the cold chamber and an opposite rear side facing away from the cold chamber;

a light source arrangement having at least one light-emitting diode being the source of the light passing into the cold chamber, wherein, when viewed perpendicularly to the pane plane of the light outlet pane, the at least one light-emitting diode is concealed and is not directly visible from the cold chamber;

a reflector body which forms a light reflection surface for reflecting light in the direction towards the light outlet pane, which light reflection surface is arranged behind the light outlet pane and has a region which is visible when viewed perpendicularly to the pane plane of the light outlet pane, and is irradiated by the at least one light-emitting diode of the light source arrangement, wherein the light outlet pane is fixed to the reflector body; and a frame part which is produced separately from the reflector body and the light outlet pane and protrudes from the at least one of the delimiting walls on the side thereof facing towards the cold chamber, which frame part forms a visible surface which extends all around the light outlet pane and is exposed towards the cold chamber;

wherein in an unmounted state, in which the lighting module is not mounted in the wall opening of the delimiting wall, the frame part is held in place between the reflector body and the light outlet pane through interlocking engagement of the frame part behind the rear side of the light outlet pane, and in a mounted state in which the lighting module is mounted in the wall opening of the delimiting wall, the interlocking engagement continues securing the frame part against falling out from the lighting module in the direction of the cold chamber;

wherein the frame part is a surface-coated plastics component; and wherein the reflector body forms a support shoulder which extends within the contour of the light outlet pane at a distance from the pane edge and on which the light outlet pane rests.

2. The domestic cooling device according to claim 1, wherein the frame part engages behind the rear side of the light outlet pane up to the support shoulder.

3. The domestic cooling device according to claim 1, wherein the frame part is free of a welded connection or an adhesive-bonding connection to the reflector body and the light outlet pane.

4. The domestic cooling device according to claim 1, wherein the reflector body is a white plastics body.

5. The domestic cooling device according to claim 1, wherein the light outlet pane is fixed to the reflector body by a welded connection.

6. The domestic cooling device according to claim 5, wherein the welded connection is an ultrasonically welded connection.

7. The domestic cooling device according to claim 1, wherein the surface-coated plastics component of the frame part is coated with a lacquer.

8. The domestic cooling device according to claim 1, wherein the surface-coated plastics component of the frame part is chromium plated.

9. The domestic cooling device according to claim 1, wherein the lighting module further comprises holding structures formed on a housing base body such that the at least one lighting module is secured thereby into the wall opening of the at least one of the delimiting walls of the cold chamber.

10. The domestic cooling device according to claim 9, wherein the holding structures are a plurality of resiliently deflectable clamping tongues.

11. A domestic cooling device capable of cooling food, the domestic cooling device comprising:

a cold chamber accessible through a door opening delimited by walls, the cold chamber having at least one shelf capable of holding the cooling food; and at least one lighting module mounted into a wall opening of at least one of the delimiting walls of the cold chamber, wherein the lighting module comprises:

at least one holding structure formed on a housing base body such that the at least one lighting module is solely secured thereby to the at least one of the delimiting walls of the cold chamber;

a light outlet pane through which light passes into the cold chamber;

a light source arrangement having at least one light-emitting diode which is the source of the light passing into the cold chamber, wherein the at least one light-emitting diode emits the light along a main beam axis in a first direction parallel to the at least one of the delimiting walls;

a reflector body having a light reflection surface for being irradiated by the light of the at least one light-emitting diode of the light source arrangement in the first direction, and then for reflecting the light in a second direction being perpendicular to the at least one of the delimiting walls towards the light outlet pane, wherein the light reflection surface is arranged behind the light outlet pane when viewed perpendicularly to the pane plane of the light outlet pane, and wherein the light outlet pane is fixed to a support shoulder of the reflector body; and a frame part being separate from the reflector body, the at least one holding structure, and the light outlet pane, wherein the frame part protrudes from the at least one of the delimiting walls on a side thereof facing towards the cold chamber, and the frame part forms a visible surface which extends all around the light outlet pane and is exposed towards the cold chamber;

wherein when in an unmounted state, in which the lighting module is not mounted in the wall opening of the at least one of the delimiting walls, the light outlet pane is fixed to a support shoulder of the reflector body and the frame part is solely held in place through interlocking engagement of the frame part and the light outlet pane; and wherein the frame part is a surface-coated plastics component.

12. The domestic cooling device according to claim 1, wherein the light reflection surface has one or more surface regions providing a diffuse scattering effect for light emitted by the at least one light emitting diode.

13. The domestic cooling device according to claim 1, wherein the at least one light-emitting diode emits the light along a main beam axis in a first direction which is parallel to the at least one of the delimiting walls; and the light reflected by the light reflection surface is reflected in a second direction which is perpendicular to the at least one of the delimiting walls.

14. The domestic cooling device according to claim 1, wherein the reflection body and the light reflection surface extends curved in an arcuate manner between a first end region and a second end region.

15. The domestic cooling device according to claim 1, wherein the reflection body and the light reflection surface each have a first end region which is parallel to the at least one of the delimiting walls, and a second end region which is perpendicular to the at least one of the delimiting walls.

16. The domestic cooling device according to claim 1, wherein the at least one light-emitting diode is positioned relative to the light emitting plane at an angle greater than zero.

* * * * *